US008122532B2

(12) United States Patent
Krämer

(10) Patent No.: US 8,122,532 B2
(45) Date of Patent: Feb. 28, 2012

(54) DEVICE FOR FASTENING A COVERING SHROUD ON A PIECE OF FURNITURE, AND PIECE OF FURNITURE EQUIPPED WITH SUCH A FASTENING DEVICE

(75) Inventor: Jörg Krämer, Merzig-Besseringen (DE)

(73) Assignee: Villeroy & Boch AG, Mettlach (DE)

( * ) Notice: Subject to any disclaimer, the term of this patent is extended or adjusted under 35 U.S.C. 154(b) by 49 days.

(21) Appl. No.: 12/522,298

(22) PCT Filed: Nov. 7, 2007

(86) PCT No.: PCT/EP2007/009620

§ 371 (c)(1),
(2), (4) Date: Jul. 7, 2009

(87) PCT Pub. No.: WO2008/083781

PCT Pub. Date: Jul. 17, 2008

(65) Prior Publication Data

US 2010/0024119 A1 Feb. 4, 2010

(30) Foreign Application Priority Data

Jan. 8, 2007 (DE) ..... 20 2007 000 508 U

(51) Int. Cl.
*A47K 1/05* (2006.01)

(52) U.S. Cl. ..... 4/643; 4/654

(58) Field of Classification Search ..... 4/643–649, 4/654; 24/298, 302; 248/74.2, 74.3, 500
See application file for complete search history.

(56) References Cited

U.S. PATENT DOCUMENTS 1,040,735 A * 10/1912 Mueller et al. ..... 4/654
(Continued)

FOREIGN PATENT DOCUMENTS

DE 30 21 680 A1 12/1981
(Continued)

*Primary Examiner* — Gregory Huson
*Assistant Examiner* — Janie Christiansen
(74) *Attorney, Agent, or Firm* — Foley & Lardner LLP

(57) ABSTRACT

The invention refers to a mechanism for the preferably length-adjustable fastening of a semi-pedestal (1) under furniture (2), such as a basin (2'), in particular a wash basin in a kitchen or washroom, having at least one tension member (3), which is attached, preferably releasably, on the one hand, to a mounting plate, e.g. a wall holder (4) of the furniture (2) provided with a fastening bolt (10) and, on the other hand, to the wall (5) of the semi-pedestal (1), where the tension member (3), which may be elastically compliant, is equipped in at least one terminal region (6) in the manner of a cable tie, with latching means (7), e.g. a toothed formation, and which can be introduced by way of the terminal region (6) into an accommodating element (8) which can be attached to the holder (4) of the furniture (2) and/or the wall (5) of the semi-pedestal (1) and formed as a counter-latching element and can be held there as well as furniture equipped with at least one such mechanism.

16 Claims, 2 Drawing Sheets

U.S. PATENT DOCUMENTS

Figure 1:
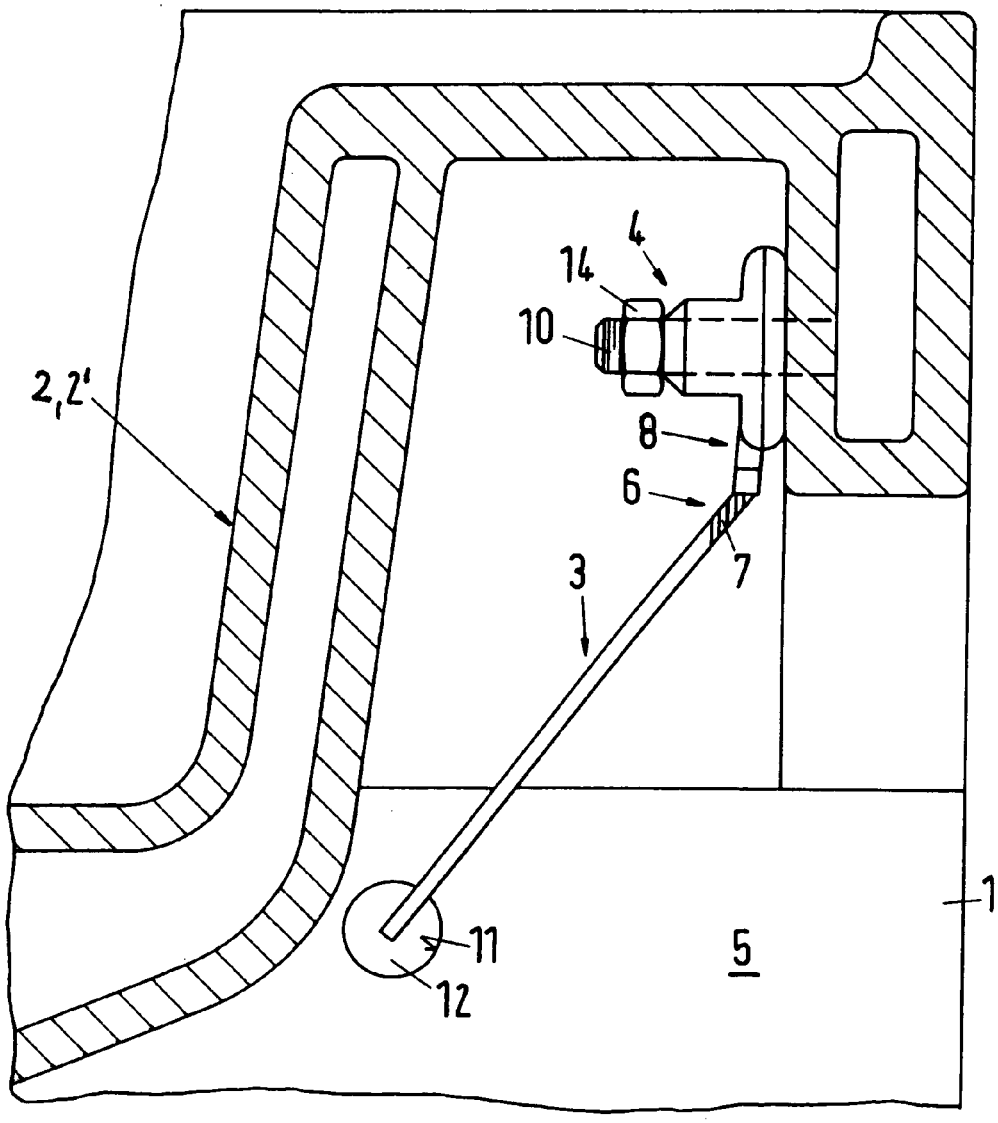

| | | | | |
|---|---|---|---|---|
| 5,265,284 | A * | 11/1993 | Dottori et al. | 4/643 |
| 6,220,562 | B1 * | 4/2001 | Konkle | 248/500 |
| 2006/0231691 | A1 * | 10/2006 | Edgren | 248/74.3 |

FOREIGN PATENT DOCUMENTS

| | | | |
|---|---|---|---|
| DE | 94 18 648 | U1 | 12/1995 |
| DE | 195 43 332 | A1 | 5/1996 |
| DE | 202 12 183 | U1 | 11/2002 |
| EP | 0 635 604 | B1 | 1/1995 |
| EP | 0 937 829 | B1 | 8/1999 |
| GB | 2 391 256 | A | 2/2004 |
| JP | 58-156487 | U | 10/1983 |
| JP | 01-084366 | U | 6/1989 |
| JP | 03-005780 | U | 1/1991 |
| JP | 2008-144845 | A | 6/2008 |

* cited by examiner

DEVICE FOR FASTENING A COVERING SHROUD ON A PIECE OF FURNITURE, AND PIECE OF FURNITURE EQUIPPED WITH SUCH A FASTENING DEVICE

The invention relates to a mechanism for fastening a semi-pedestal, preferably length-adjustably, to furniture such as, in particular, a basin, a wash basin in the washroom or a sink in the kitchen, with at least one tensioning member, which is fastenable, preferably releasably, on the one hand to a holder, e.g. a wall holder of the furniture, and on the other hand to the wall of the semi-pedestal.

Such semi-pedestals and/or siphon covers serve e.g. for covering the supply lines and/or the drain line with wall outlet and optionally siphon under a washbasin or a sink, as well as other installations, which are to be covered under the furniture. They are usually designed as so-called 'semi-pedestals'.

From EP-B-0 937 829 a washroom system is known comprising a washstand, a semi-pedestal and mechanisms for fastening the semi-pedestal to the washstand, where the washstand is fastened to the wall with a hanger bolt. The fastening mechanisms exhibit a first element, acting in the region of the washstand and fastened or fastenable to the hanger bolt, with a recess which penetrates the hanger bolt or is penetratable by it, as well as a second element, which acts on the semi-pedestal in the region of its upper margin. The fastening mechanisms further comprise a connection, where the first and the second elements for fixing the semi-pedestal to the washstand are connected or connectable together by first and/or the other end of the connection. The connection should be a screwed joint, where recesses are provided on the first and on the second element which can each be penetrated by the screwed joint. The screwed joint is to be screwed in so far, until the top margin of the semi-pedestal is pulled firmly against the lower surface of the washstand.

A wall-mountable washstand with a semi-pedestal serving to cover the water outflow pipe emerging from the washstand is known from DE-C-3 021 680, said semi-pedestal being held underneath the washstand in such a way as to be removable against spring action. Here, two holding devices are each equipped with a tension spring, where the tension springs each have one end gripping the semi-pedestal in the region of the top margin of the semi-pedestal and at a distance from the wall and with its other end gripping the washstand at a short distance from the wall, as a consequence of which the semi-pedestal is pressed both against the wall and against the washstand.

From EP-B-0 635 604 a device is known for the adjustable attachment of a wash basin to its semi-pedestal with a tension spring, where the ends of the spring end in each case in a fastening mechanism, hidden in an installed condition within the basin and to a point on the semi-pedestal. An adjusting mechanism having a screwing device serves to compress the spring to a greater or less extent.

From DE-A-195 43 332 a covering for washstands or the like is known, which surrounds the supply and discharge pipes like a half shell and is held by means of two tensioning members. The attachments holding the washstand to the wall are provided with eyelets or the like for holding the tensioning member to the wall at one end. The tensioning members are here in the form of tensioning bands and fixed with one end to the fixing lug, while the other end cooperates by means of the eyelets provided by the washstand attachment or the like as mountings.

All prior known constructions are multipartite and constructionally costly and can be installed and dismantled only with a relatively high expenditure of time. In addition tools are usually needed for the assembly.

It is an object of the present invention to propose a fastening mechanism of the kind specified in the preamble which, with a simple structure, permits rapid and easy assembly of the semi-pedestal under furniture and a correspondingly rapid and simple disassembly without tools. The free space within the semi-pedestal should be usable without reservation for the admission of inlet and outlet lines or similar installations.

This task is essentially solved in the case of a fastening mechanism of the kind specified above, for example, by the fact that the tensioning member, which may be elastically compliant, is equipped, in at least one terminal region, with a latching means, e.g. a toothing formation, in the manner of a cable tie and, by way of the terminal region, can be introduced into and fixed in an accommodating element which can be secured on the holder of the piece of furniture and/or on the wall of the semi-pedestal and is designed as a mating latching element, e.g. a mating toothing element.

The invention therefore takes advantage of the simple technology and handling of so-called cable ties, which can be manufactured at low cost and are generally available. The connection, which is stretched between the holder of the furniture and the wall of the semi-pedestal can be adjusted in length, because of the cable tie function, to suit the local conditions and is fixable in each case in the correct length so that the semi-pedestal rests both on the furniture and against the wall. If the tensioning member is preferably elastically compliant, a simple adjustment of the semi-pedestal into the finally desired assembly position can be easily managed by hand.

The tensioning member can, as can be the case with known cable ties, be in the form of tie bars, which carry the toothing on one flat side, which then cooperates with a corresponding serrated tongue of the accommodating element for fixing the tensioning member in the accommodating element.

In a particularly preferred embodiment of the invention the accommodating element has a preferably curved accommodating channel for the terminal region of the tensioning member provided with the toothing, in order to secure this in the final assembly position.

For the further simplification of the assembly, the accommodating element can be installed on the furniture holder in such a way that the entry and/or exit of the accommodating channel optionally point obliquely downwards. This permits the tensioning member to be easily introduced into the accommodating element and fastened in this by hand in the final assembly position of the semi-pedestal.

The tensioning member and the accommodating element can alternatively be equipped with the function of a disposable (non-openable) cable tie and/or a reusable (openable) cable tie, where in the latter case, for example, the check tongue of the accommodating element involved in the retention of the tensioning member can be designed to be unlockable. In the case where a disposable cable tie is used, if a disassembly and re-assembly should be necessary, this is simply destroyed, for example, by cutting, and exchanged for a new one.

The invention further provides that the accommodating element is attachable in particular, for example, with a loop or an eye, to an existing fastening bolt of the holder of the furniture and retained there, if necessary, by means of a nut. This is done, in particular, in such a way that the accommodating element remains rotatable around the axis of the bolt, so that it is still possible to orient the accommodating channel during assembly to suit the local and/or spatial conditions.

The invention leaves open, whether the cable tie function is effected only in the terminal regions of the tensioning members in neighbourhood of the holder, in particular a wall holder of the furniture, in particular a basin, or also in the vicinity of the wall of the semi-pedestal, or vice versa. In practice, it has been found to work satisfactorily for the tensioning member with its end turned towards the wall of the semi-pedestal to be suspended in a wall opening, e.g. side panel opening, of the semi-pedestal, if the length adjustment is already carried out by a cable tie function in the vicinity of the holder with the accommodating element provided there. This solution ensures a rapid assembly.

For the latter case, for example, one end of the tensioning member gripping through the wall opening is provided with a wall opening cap cover after assembly (from the outside), which preferably has a colour, such as washroom colour, matching the furniture, such as washroom furniture.

To simplify the assembly the cap can exhibit a centring section engaging in the wall opening.

The tensioning member and/or the accommodating element are each preferably designed in one piece and can be made of plastic, e.g. Nylon 6.6.

The invention refers moreover to a unit comprising furniture and semi-pedestal, which is equipped with at least one fastening mechanism of the kind hereinbefore described.

Two tensioning members are preferably provided, one left, one right and preferably disposed symmetrically on either side of the vertical centre line of the furniture, which each co-operate with at least one accommodating element, preferably provided on the appropriate holder of the furniture.

Further goals, characteristics, advantages and possible applications of the invention can be seen from the following embodiments, with the aid of drawings of furniture in the form of basins, in particular washstands. All features described and/or represented in drawings, per se or in any meaningful combination, form the subject matter of the invention, and independent of their summary in individual claims or retroactively.

Figure 2A:
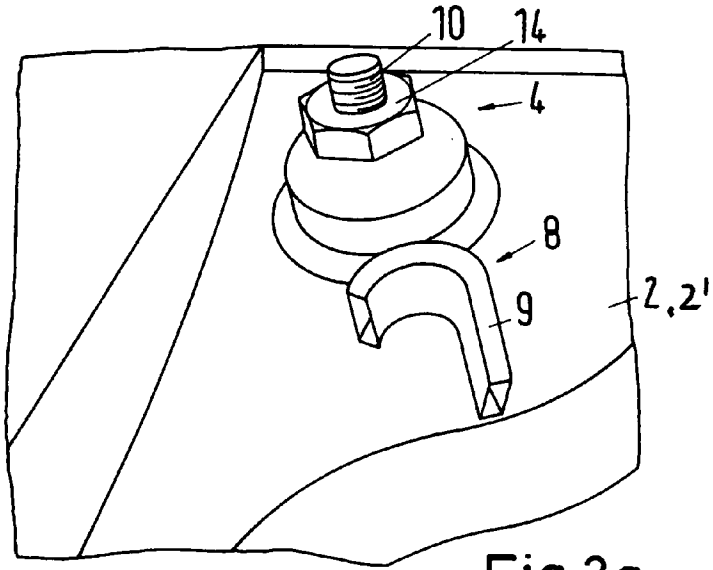
Figure 3B:
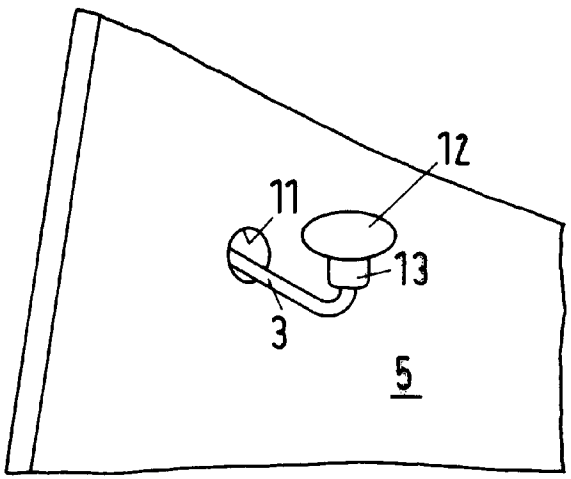
Figure 2B:
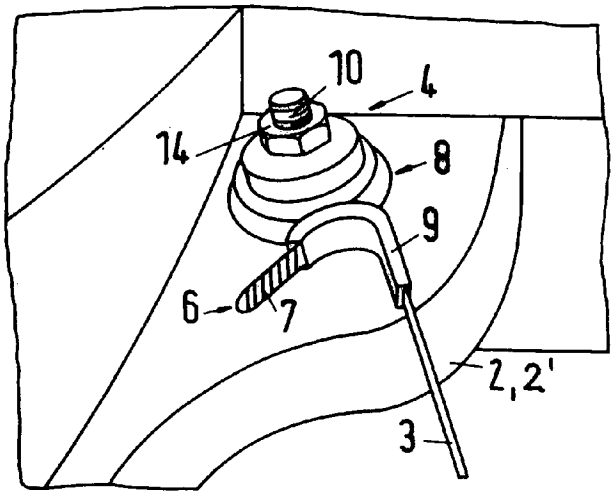
Figure 3A:
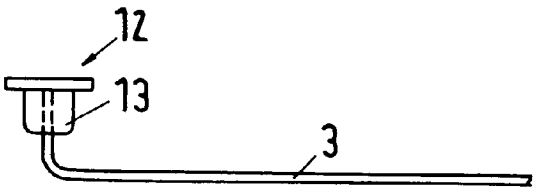

These show:

FIG. 1 schematically in vertical section a washstand illustrating the invention with a fastening mechanism in accordance with the invention for the semi-pedestal under a basin attached to a wall of a building, FIG. 2*a* schematically in cross-section an accommodating element attached to a wall holder of the basin, with an accommodating channel for the tensioning member, FIG. 2*b* a similar representation to FIG. 2*a*, where the tensioning member is inserted into the accommodating channel, passes through it and, with a free end, projects from the accommodating channel, FIG. 3*a* a tensioning member in accordance with the invention in the region opposite to the wall holder for the basin and with the end of the tensioning member to be connected to the semi-pedestal, and FIG. 3*b* a schematic section of a semi-pedestal side panel with an opening for the introduction of the cable-tie-like tensioning member in accordance with the invention.

In accordance with FIG. 1 the mechanism in accordance with the invention for fastening a semi-pedestal 1 to furniture 2 in the form of a basin 2' exhibits a tensioning member 3 in the form of a flat tension member, which is releasably fastened, on the one hand, to a holder 4 of the basin 2' in the form of a wall holder and, on the other hand, to the wall 5 of the semi-pedestal 1. In the case represented only one fastening mechanism is visible. Under normal conditions an appropriate fastening mechanism is symmetrically disposed on either side of the vertical centre plane of the basin 2', where these lead in each case from a wall holder 4 to the corresponding side wall 5 of the semi-pedestal 2.

The optionally sectionally elastically compliant tensioning member 3 has, in its terminal region 6 directed towards the wall holder 4, depending on the type of cable tie, latching means 7, with which terminal region 6 the tensioning member 3 can be introduced into an accommodating element 8 on the wall holder 4 of the basin 2' and retained there. The accommodating element 8 is thus designed as a counter retaining element for the latching means 7 of the tensioning member 3. Since the latching means 7 of the tensioning member 3 extends over a certain length of the tensioning member 3, the fastening mechanism is length-adjustable to suit the spatial and local conditions and the dimensions of the semi-pedestal 1 and basin 2'.

It can be seen, in particular from the FIGS. 2*a* and 2*b*, that the accommodating element 8 has a curved accommodating channel 9 for the terminal region 6 of the tensioning member 3 provided with the latching means 7. The accommodating element 8 is attached to the wall holder 4 of the basin 2 in such a way that the entry and outlet of the accommodating channel 9 point diagonally downward. The mechanic can thus easily push the terminal region 6 of the tensioning member 3 having the latching means 7 into the entry opening of the accommodating channel 9, until the free end projects from the outlet of the accommodating channel 9 and can be pulled downwards, until the semi-pedestal 2 reaches its final assembly position, in which it impinges, on the one hand, from below on the basin 2' and, on the other hand, on the building wall serving for the attachment of the basin 2'. The final, also lateral positioning of the semi-pedestal 1 is easily possible due to an optional flexible compliance of the tensioning member 3 and/or adjustability of the accommodating element 8 on the fastening bolt 10.

As can be seen from the FIGS. 2*a* and 2*b* in particular, the accommodating element 8 can be attached with an appropriate loop or eye-like fitting to the attachment bolt 10 of the wall holder 4 of the basin 2' and be held there with the help of the nut 14 on the wall holder 4 in such a manner that the accommodating element 8 remains rotatable around the axis of the bolt.

In accordance with the FIGS. 3*a* and 3*b* the tensioning member 3 has a cap 12 at the end turned away from the wall holder 4 and accordingly towards a wall 5 of the semi-pedestal 1 with a centring section 13, which can engage in a centring manner in the wall opening 11 of the wall 5.

In starting the assembly of the fastening mechanism in accordance with invention therefore first the end 6 of the tensioning member 3 which is provided with the latching means 7 is inserted through the wall opening 11 and passed into and through the accommodating channel 9.

Then the tensioning member 3 can be pulled tight up to the final assembly position of the semi-pedestal 1, so that the cap 12 lies over the wall opening 11 of the wall 5.

REFERENCE SYMBOL LIST

1 Semi-pedestal
2 Furniture
2' Basins
3 Tensioning member
4 Holder, in particular wall holder
5 Wall
6 Terminal region
7 Latching means
8 Accommodating element
9 Accommodating channel

10 Fastening bolts
11 Wall opening
12 Cap
13 Centring section
14 Fastening nut

The invention claimed is:

1. Semi-pedestal under a washbasin or a sink in a kitchen or washroom, with a fastening mechanism, having at least one tension member which can be fastened on the one hand to a holder of the washbasin or sink and on the other hand to the wall of the semi-pedestal, wherein the tension member is equipped with latching means in the manner of a cable tie, at least in its one terminal region, and can be inserted, with the terminal region into an accommodating element formed as a counter-latching element attached to the holder of the washbasin or sink and/or the wall of the semi-pedestal, and held there, wherein the accommodating element has an accommodating channel for the terminal region of the tension member provided with the latching means, and wherein the tension member can be suspended by one end directed towards the wall of the semi-pedestal in a wall opening of the semi-pedestal, with one end of the tension member penetrating through the wall opening being provided with a cap covering the wall opening after assembly.

2. Semi-pedestal in accordance with claim 1, wherein the tension member is formed as a draw-tape, which carries the latching means on a flat side.

3. Semi-pedestal in accordance with claim 1, wherein the accommodating element is attached to the holder of the washbasin or sink in such a way that an entry and/or exit of the accommodating channel points downwards.

4. Semi-pedestal in accordance with claim 1, wherein the tension member and the accommodating element are equipped with the function of a disposable cable tie and/or a reusable cable tie.

5. Semi-pedestal in accordance with claim 1, wherein the accommodating element can be attached to the fastening bolt of the holder of the washbasin or sink and retained.

6. Semi-pedestal in accordance with claim 1, the cap exhibits a centring section engaging in the wall opening.

7. Semi-pedestal in accordance with claim 1, wherein the tension member and/or the accommodating element are made of plastic.

8. Washbasin or sink, which is equipped with a semi-pedestal in accordance with claim 1.

9. Washbasin or sink in accordance with claim 8, wherein two tension members are provided, one left and one right of a vertical centre line of the washbasin or sink and which each co-operate with at least one accommodating element.

10. Method for the fastening of a semi-pedestal under a washbasin or sink in the kitchen or washroom comprising the steps of:

providing and using a mechanism having at least one tension member, which is to be fastened on the one hand to a holder having a fastening bolt and on the other hand to the wall of the semi-pedestal where the tension member, provided at least in its terminal region with latching means, of the nature of a cable tie can be introduced into an accommodating member formed as a mating latching element attached to the holder of the washbasin or sink and/or the wall of the semi-pedestal and held there, wherein the accommodating element has an accommodating channel for the terminal region of the tension member provided with the latching means; and suspending the tension member by one end directed towards the wall of the semi-pedestal in a wall opening of the semi-pedestal, with one end of the tension member penetrating through the wall opening being provided with a cap covering the wall opening after assembly.

11. Method in accordance with claim 10, wherein the tension member is formed as a pull strip which has latching means on a flat side.

12. Method in accordance with claim 10, wherein the accommodating element is attached to the holder of the washbasin or sink in such a way that an entry and/or exit of the accommodating channel point downwards.

13. Method in accordance with claim 10, wherein the tension member and the accommodating element are equipped with the function of a disposable cable tie and/or a reusable cable tie.

14. Method in accordance with claim 10, wherein the accommodating element is to be attached to the fastening bolt of the holder of the washbasin or sink and secured.

15. Method in accordance with claim 10, wherein the cap is provided with a centring section engaging in the wall opening.

16. Method in accordance with claim 10, wherein the tension member and/or the accommodating element are made of plastic.

* * * * *